United States Patent [19]

Scislowicz et al.

[11] 3,938,520

[45] Feb. 17, 1976

[54] TRANSFER UNIT HAVING A DUAL CHANNEL TRANSFER MEMBER

[75] Inventors: Henry Scislowicz, Lake Bluff, Ill.; Thomas A. Frazier, Williamsport, Pa.

[73] Assignee: Abbott Laboratories, North Chicago, Ill.

[22] Filed: June 10, 1974

[21] Appl. No.: 477,876

[52] U.S. Cl. ..... 128/272.3; 128/214 R; 141/330; 215/247; 222/83

[51] Int. Cl.[2] ..... A61J 01/08

[58] Field of Search ..... 128/272, 215, 216, 218 M, 128/218 NV, 221, 214 C, 214 R, 214.2, DIG. 28; 222/80–82, 525, 563, 564, 569, 531, 83; 141/19–28, 329, 330; 206/219; 215/307, 250, 247; 137/595

[56] References Cited

UNITED STATES PATENTS

| | | | |
|---|---|---|---|
| 2,289,677 | 7/1942 | Perelson | 215/247 |
| 2,661,740 | 12/1953 | Hickey | 128/218 NV |
| 2,953,132 | 9/1960 | Richter et al. | 128/272 |
| 2,973,758 | 3/1961 | Murrish | 128/273.3 |
| 3,150,661 | 9/1964 | Maki | 128/218 NV |
| 3,206,073 | 9/1965 | Scislowicz | 128/272 UX |
| 3,316,908 | 5/1967 | Burke | 128/214 C |
| 3,580,423 | 5/1971 | Gilman | 222/81 |
| 3,608,550 | 9/1971 | Stawski | 128/272 |
| 3,662,752 | 5/1972 | Yokoyama | 128/221 |
| 3,662,753 | 5/1972 | Tassell | 128/218 M |
| 3,768,697 | 10/1973 | Lerner | 222/80 |
| 3,802,604 | 4/1974 | Morane et al. | 222/83 |
| 3,882,909 | 5/1975 | Ogle | 128/272 X |
| 3,885,607 | 5/1975 | Peltier | 128/272 X |

FOREIGN PATENTS OR APPLICATIONS

| | | | |
|---|---|---|---|
| 1,178,578 | 10/1958 | France | 128/221 |

*Primary Examiner*—Dalton L. Truluck
*Attorney, Agent, or Firm*—Robert L. Niblack; Gildo E. Fato; Neil E. Hamilton

[57] ABSTRACT

Disclosed is a transfer unit for transferring a material within a container, the material being in either powdered or liquid form, to a second container having a diluent therein, to thereby form a solution. The unit includes a container for storing the material, a closure portion including a frangible diaphragm for sealing the container prior to use, the transfer member having dual channels therein, one for the transfer of material from the additive container to the second container, the other for passage of air into the second container. The unit is employed by inserting the transfer member through the closure in the second container, transferring the material within the container to the second container and thereafter removing the transfer unit. In the preferred embodiment, the closure portion and container is removable from the transfer member. The transfer member is therefore retained within the closure of the second container. The exterior projecting portion of the transfer member can be adapted to receive the tip of a syringe whereby solution within the second container can be removed. The transfer unit is particularly adaptable for transfer of the material therein to a second container sealed under a vacuum.

16 Claims, 12 Drawing Figures

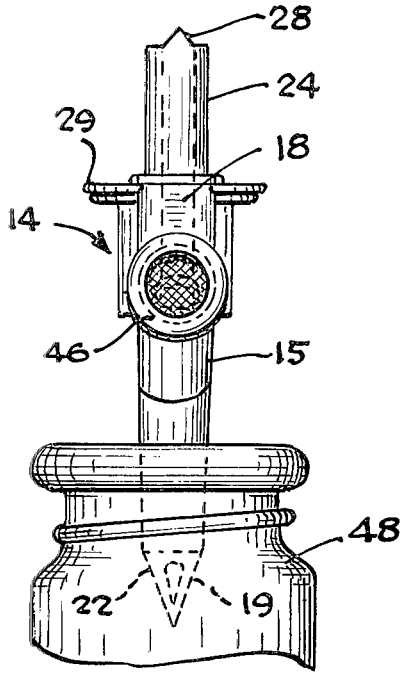
FIG.8
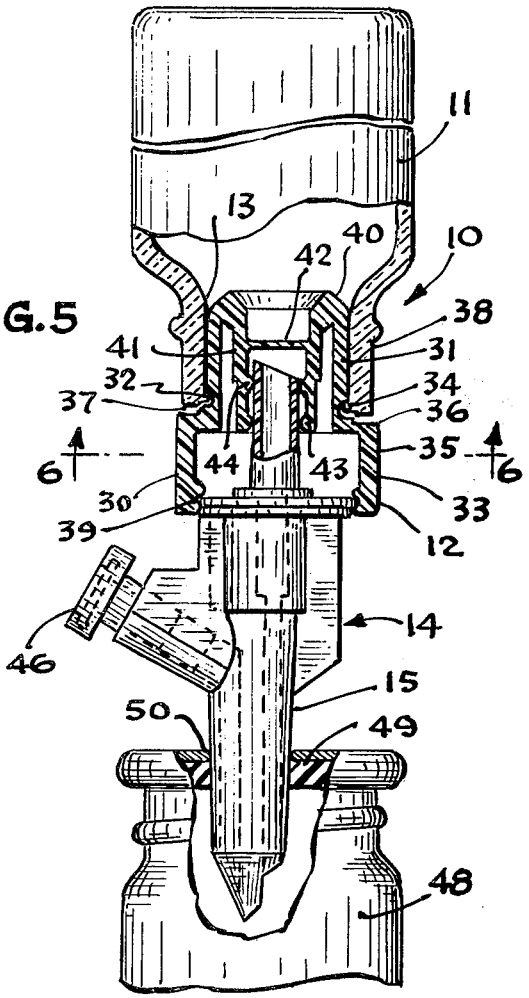
FIG.5
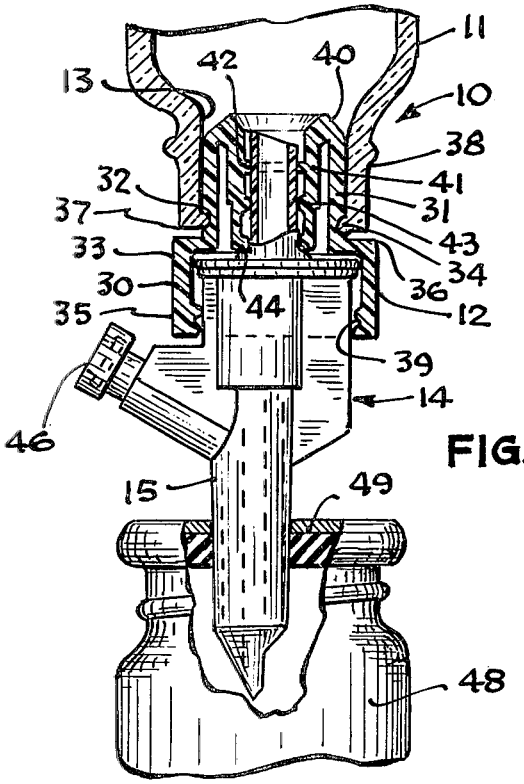
FIG.7
FIG.6
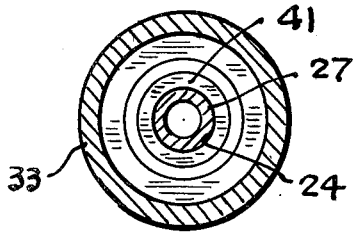

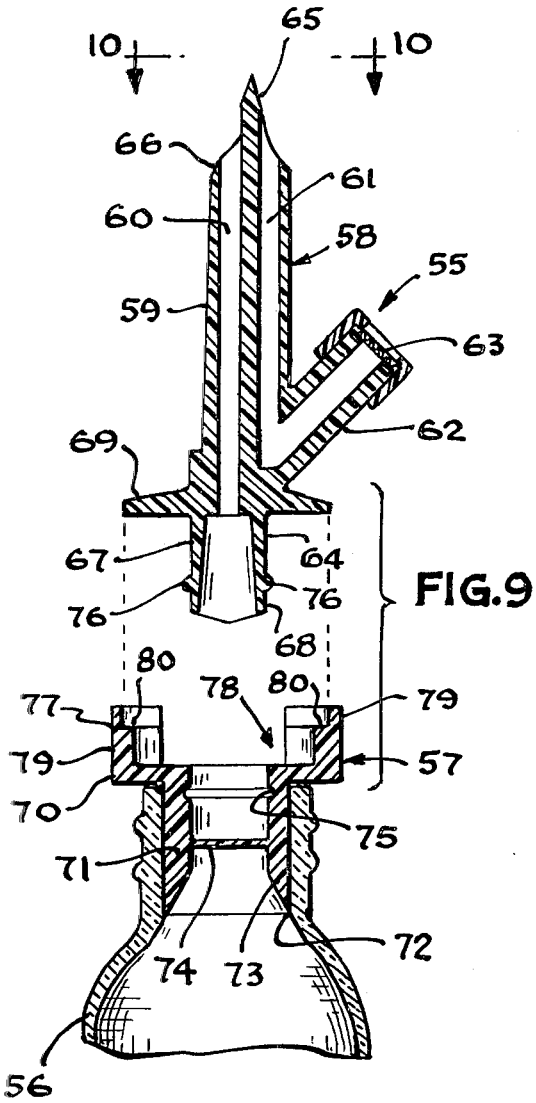
FIG.9
FIG.10
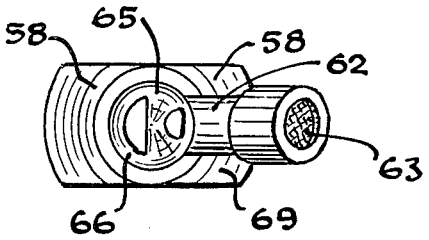
FIG.11
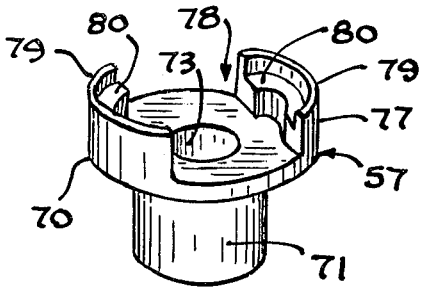
FIG.12
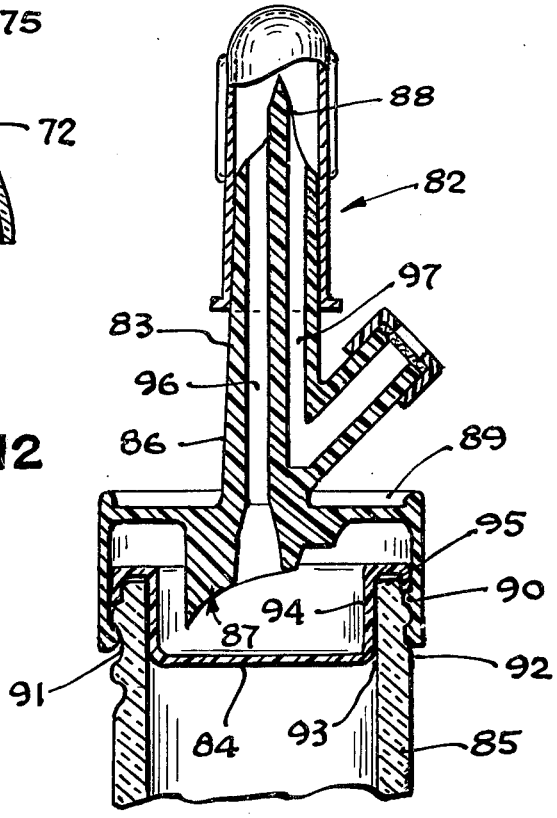

TRANSFER UNIT HAVING A DUAL CHANNEL TRANSFER MEMBER

BACKGROUND OF THE INVENTION

With a container sealed with a puncturable stopper, it is difficult to add material thereto once the container is sealed. Material can be added to the diluent within the container by puncturing the stopper with the needle of a syringe and injecting the material within the syringe into the container. However, such a procedure is not very desirable for a number of reasons such as the possibility of coring of the stopper material by the needle whereby particles of the material may enter the syringe. While containers sealed by a puncturable stopper can be employed for a number of purposes or uses, such containers are quite commonly used for the packaging of medical solutions.

Oftentimes, in medical procedures for example, it is necessary to prepare a solution of a medicament by adding the medicament to sterile water or to another solution. In situations wherein the additive medicament exhibits some instability when in solution, the final solution cannot be prepared in final form since such solutions cannot be stored for sufficiently long enough periods to provide for handling and shipping of the premixed solution. In such cases, it is necessary to mix the additive medicament and sterile water or other diluent just prior to use. With medical solution containers incorporating a screw type enclosure, addition of the medicament can be accomplished by simply removing the screw cap, adding the medicament, and mixing the solution. However, most medical solutions are presently packaged in glass or plastic containers with the container being sealed by a puncturable closure or stopper. Consequently, specially designed packages are required in order to add medicaments to such containers, particularly if they are sealed under a vacuum.

Various additive containers are presently available, such as illustrated in U.S. Pat. No. 3,055,367 issued Sept. 25, 1962. With such containers, which include a piercing member for entry through the puncturable closure of the solution bottle, transfer of the medicament within the container is made by piercing the stopper in the solution bottle whereupon the vacuum therein will draw the medicament within the container into the bottle. Where the medicament is in powder form or the solution container is not under vacuum however, such containers do not ensure complete transfer of the powdered medicament into the solution bottle. Further, with such containers, in order to withdraw a portion of the mixed solution from the solution container, it is necessary to completely withdraw the additive container and enter the closure by means of a syringe to withdraw the desired amount of mixed solution. Entry of a needle through the closure raises the possibility of coring of the stopper material by the needle whereby particles of the material may enter the syringe. Further, after repeated entry through the stopper, there is a possibility of creating a hole or passageway through the stopper which could result in contamination of the solution within the container.

SUMMARY OF THE INVENTION

The present invention comprises a container for transferring of a material within the container to a second container having a diluent therein. The unit comprises a container for storing the material, a closure portion including a frangible diaphragm for sealing the container prior to use, and a transfer member disposed within the closure for transfer of the material within the container to the diluent in the second container to thereby form a solution or mixture. The transfer member comprises a body portion having a point on either end, the body of the pin having dual channels therein, one for the transfer of material from the additive container to the second container, the other for the passage of air into the second container.

The unit is employed by piercing the closure of the second container with the projecting, pointed end of the transfer member. As further pressure is applied, the transfer member slides within the closure whereby the other end of the member pierces the diaphragm within the closure thereby providing a passageway for transfer of the material within the container into the second container. As the material is being transferred, air can enter the second container through the air channel in the transfer member. After transfer of the material within the container is effected, the container and closure portion can be removed, leaving the transfer member projecting from the closure in the second container. The portion of the transfer member projecting from the second container can be adapted to receive the tip of a syringe so that a portion of the mixed solution can be conveniently withdrawn from the second container. The transfer unit of the present invention is particularly adapted for the transfer of material to a second container which has been sealed under a vacuum such as for example, medical solution containers.

DRAWINGS

The present invention can be better understood by reference to the following description and drawings in which:

FIG. 5 is a side elevational view, partially in cross section, illustrating the transfer unit of the present invention as inserted in the closure of a vacuumized bottle prior to complete activation of the unit, FIG. 6 is a cross sectional view taken along the line 6—6 of FIG. 5;

FIG. 7 is a side elevational view, partially in cross section, illustrating the transfer unit of the present invention when fully activated, providing a passageway between the two containers;

FIG. 8 is a side elevational view illustrating the transfer member retained in the vacuumized bottle with the container and closure portion removed preparatory to withdrawing the mixed solution from the bottle;

FIG. 9 is a side elevational view, in cross section, illustrating another embodiment of the transfer unit of the present invention;

FIG. 10 is a top plan view of the transfer member portion of the transfer unit of FIG. 9 as seen along the lines 10—10 thereof;

FIG.11 is a perspective view of the closure portion of the transfer unit of FIG. 9; and FIG. 12 is a side elevational view, in cross section, of a further embodiment of the transfer unit of the present invention. FIG. 11

DETAILED DESCRIPTION

The transfer unit 10 of the present invention can be used for the transfer of a material within the container thereof to a second container having a diluent therein to thereby form a solution. The material can be in either powdered or liquid form. The transfer unit 10 is particularly adapted for the transfer of a material into a second container sealed with a puncturable stopper. Preferably, the container portion 11 of the transfer unit 10 is made of a flexible material such as plastic so that the resultant container is squeezable. Since the transfer member portion 14 includes a separate air channel therein, air can enter into the system when the transfer member 14 is inserted through the puncturable stopper so that the transfer of material is facilitated. While the transfer unit 10 has a number of uses, to facilitate a better understanding of the invention, the transfer unit 10 and its application will be described in conjunction with the addition of an additive medicament to a medical solution container, which may be glass or plastic, either semirigid or flexible, sealed by a puncturable stopper, the glass or semirigid plastic containers generally being sealed under a vacuum while the flexible containers are sealed at atmospheric pressure.

Figure 2:
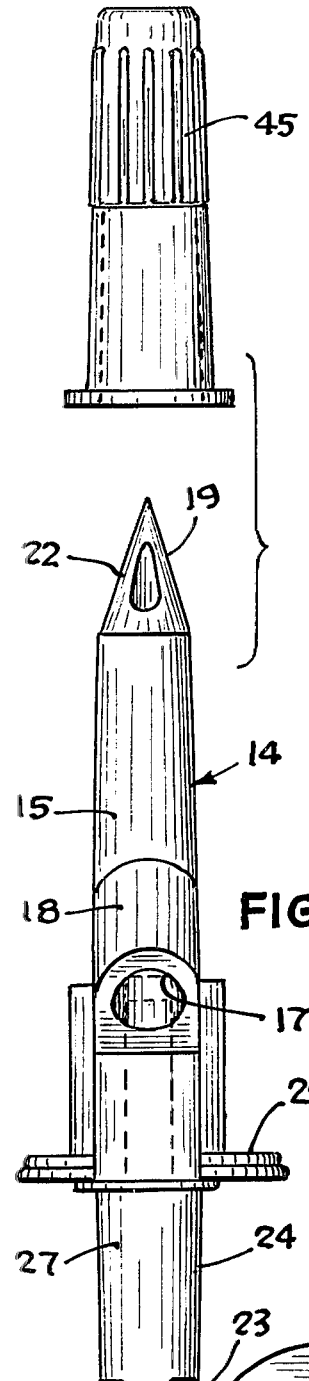
FIG. 2 is a front elevational view of the transfer member as viewed along the line 2—2 of FIG. 1, and including a protective hood for covering the projecting portion of the transfer member.
Figure 3:
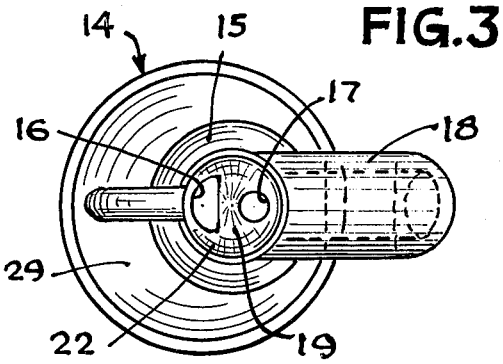
FIG. 3 is a top plan view of the transfer member as viewed along the line 3—3 of FIG. 1.
Figure 1:
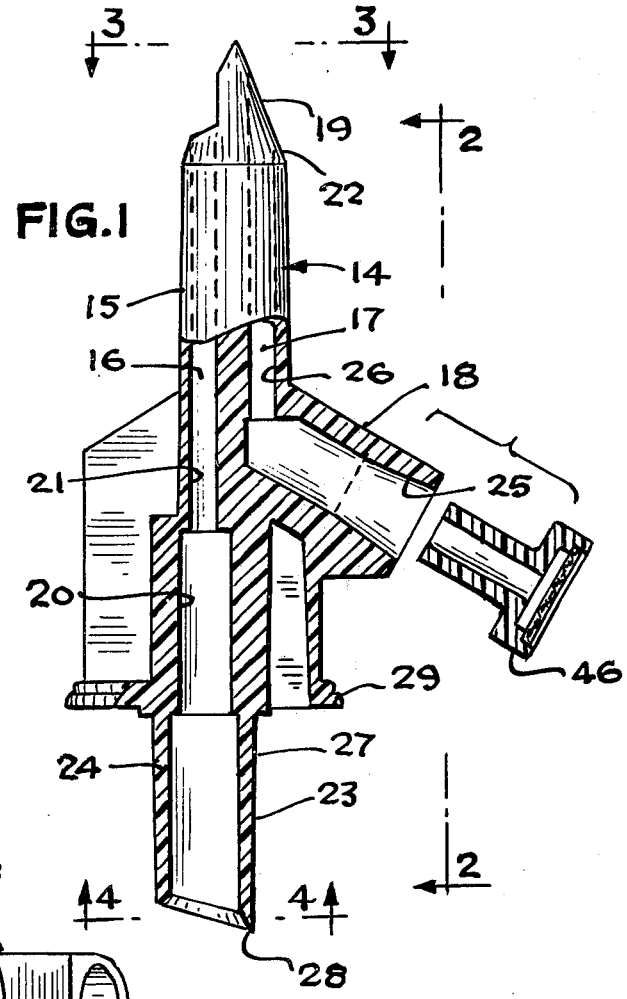
FIG. 1 is a side elevational view, partially in cross section, illustrating the transfer member of the present invention.
Figure 4:
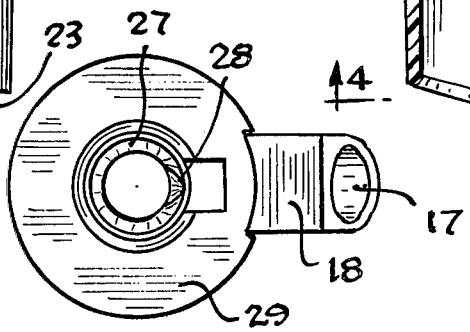
FIG. 4 is a bottom plan view of the transfer member as viewed along the line 4—4 of FIG. 1.

Referring to FIG. 5, the transfer unit 10 of the present invention comprises a container 11 for storing the medicament prior to use and a closure portion 12 sealing the opening 13 in the container 11 and for retaining a transfer member 14 for transfer of the medicament within the container 11 to a second container which may be a vacuumized solution container. As best seen in FIG. 1, the transfer member 14 comprises a body portion 15 having two channels 16, 17 therein, one extending longitudinally the length of the body 15 to provide a passageway 16 for the transfer of medicament and diluent between the container 11 and the vacuumized container. The body 15 includes an angularly extending portion 18 spaced between the ends of the transfer member 14, the second channel 17 extending through the angularly extending portion 18 and the body 15 to the piercing end 19 and providing a passageway 17 for the entry of air into the second container as hereinafter described.

As illustrated in FIG. 1, the passageway 16 for the transfer of medicament and diluent between the container 11 and the second container has a stepped construction including portions 20, 21 of varying diameters. The cutting element 23 on the interior end 24 of the body 15 is constructed so as to receive the tip of a syringe, the interior diameter thereof thereby being fixed. To minimize the size of the body 15 and the piercing end 19, the passageway 16 is therefore stepped downwardly in size in comparison to the size of the cutting element 23 or interior end 24, as illustrated. The relative sizes of the fluid passageway 16 and the air channel 17 being selected to permit the entry of sufficient air during the transfer of material and diluent between the containers. Likewise, the air channel 17 has portions 25, 26 of varying size, the angularly extending portion 18 being adapted to receive a filter 46.

The body 15 of the transfer member 14 includes a piercing end 19 or point on the exterior end 22 of the body 15 and a cutting element 23 on the opposite or interior end 24 of the body 15. The cutting element 23 comprises a tubular projection 27 extending from the body 15 and depends into the closure 12 when the unit 10 is assembled. Preferably, the projection 27 terminates in a sharpened end 28 to facilitate rupture of the closure diaphragm as hereinafter described. An annular flange 29 projects from the body 15 of the transfer member 14 spaced from the interior end 24 of the body 15 and serves to aid in retaining the transfer member 14 within the closure portion 12.

As illustrated in FIG. 5, the closure portion 12 includes a body portion 30 having a tubular section 31, the diameter of the tubular section 31 being such as to provide an interference fit with the diameter of the opening 13 in the container 11, the tubular section 31 being disposed within the opening 13 to seal the opening. The transfer unit 10 includes a first locking means between the closure 12 and the container 11 and a second locking means between the closure 12 and the transfer member 14. The first locking means retains the closure 12 within the container 11 and is fabricated to firmly retain the closure 12 and container 11 in engagement. The second locking means can be fabricated to be releasable so that after entry of the transfer member 14 through the puncturable stopper, the second locking means can be released without releasing the first locking means. Such a construction will permit removal of the container 11 and closure portion 12 of the transfer unit 14 so that the transfer member 14 can be retained within the stopper as hereinafter described. In the embodiment described, the second locking means can be made releasable without at the same time releasing the first locking means by adjusting the radial depth of the groove or undercut 39 on the inside wall of the closure 12.

The tubular section 31 includes an undercut 32 around the periphery thereof, spaced toward the exterior portion 33 of the closure 12, the undercut 32 mating with a ridge 34 formed in the opening 13 of the container 11 and projecting inwardly, the combination serving to retain the closure 12 within the opening 13 in the container 11 and comprising an example of the first locking means. Preferably, the tubular section 31 includes a taper 40 on the end thereof to facilitate insertion of the closure 12 within the opening 13 in the container 11. The closure 12 includes an enlarged portion 35 including a shoulder 36 for abutment with the finish 37 of the neck 38 of the container 11 when the closure 12 is inserted within the opening 13 in the container 11, the enlarged portion 35 including an undercut 39 on the inside wall thereof for receiving the flange 29 of the transfer member 14. The interior end 24 of the transfer member 14 is received by a guide 41 within the closure member 12, the end of the guide 41 being sealed by a rupturable diaphragm 42. As illustrated, the guide 41 receives the cutting element 23, the tubular projection 27 being slidably received therein, the guide 41 extending inwardly into the body 30 of the closure 12. Sealing rings 43, 44 extend around the inside of the guide 41 and engage the tubular projection 27 frictionally to prevent the leakage of fluid around the transfer member 14, aid in maintaining sterility and keep the transfer member 14 rigid during penetration of the stopper 49. The sealing rings 43, 44 also facilitate the separation of the transfer member 14 from the closure 12 as hereinafter described, as compared to an interference fit for example. A diaphragm 42 seals the guide 41 and in use, is broken by the sharpened end 28 of the cutting element 23.

After the container 11 is filled with the desired medicament, the closure portion 12 and transfer member 14 are assembled together and the closure 12 inserted within the opening 13 in the container 11. The annular undercut 32 in the tubular section 31 of the closure 12 and the opposed ridge 34 in the neck 38 of the container 11 serving to hold the two parts together and comprising an example of the second locking means. The closure portion 12, transfer member 14 and container 11 can be sterilized prior to filling the container 11. Preferably, the transfer member 14, hood 45, filter 46 and closure 12 are preassembled and sterilized, the assembly then being inserted into the sterilized, filled, container 11. All of the parts of the unit 10 can be made from a suitable plastic material, the container 11 preferably being flexible.

While most useful for the addition of a powdered medicament to a solution within a vacuumized bottle, the unit 10 also can be used for the transfer of a liquid material from the container 11 to a second container 48. With some materials, such as sodium thiopental which is useful as an anesthetic and is injected directly into a patient, a premixed solution cannot be prepared since sodium thiopental tends to degradate on extended storage. Such materials can be packaged in the container 11 of the present transfer unit 10 and then mixed with a diluent such as sterile water immediately prior to use. To use the transfer unit 10, a container 48 of sterile water is selected and the protective closure removed to expose the puncturable stopper 49. The protective hood 45 is then removed from the piercing end 19 of the transfer member 14 and the transfer unit 10 is positioned in place with the piercing end 19 overlying the diaphragm portion 50 of the vacuumized container stopper 49. The transfer unit 10 is then forcefully thrust into the stopper 49, the piercing end 19 on the transfer member 14 entering the container 48 through the diaphragm 50 as illustrated in FIG. 5. Concurrently, the flange 29 of the transfer member 14 which is maintained in the closure 12 by means of engagement with the undercut 39, will be released thereby permitting the closure 12 and container 11 portion of the transfer unit 10 to move downwardly along the flange 29 and body 15 of the transfer member 14. Concurrently the cutting element 23 will slide within the guide 41, the sharpened end 28 of the cutting element 23 rupturing the diaphragm 42 whereby a pathway between the container 11 and the vacuumized container 48 is provided through the fluid channel or passageway 16 as best seen in FIG. 7. As soon as a pathway between the containers is provided, most of the powder within the container 11 will transfer into the second container 48. The container 11 can then be squeezed to transfer the remaining portion of the medicament or if desired, the entire assembly can be inverted and the container 11 squeezed to draw solution into the container 11 to rinse any remaining medicament from the container 11. The container 11 and closure portion 12 of the transfer unit 10 are then removed by a twisting or bending motion which releases the flange 29 of the transfer member 14 from the closure portion 12, leaving the transfer member 14 positioned in the vacuumized container 48 as illustrated in FIG. 8. The protective hood 45 can then be placed over the interior end 24 of the transfer member 14 during storage to prevent contamination of the mixed solution during storage.

To withdraw a portion of the mixed solution from the solution container 48, the protective hood 45 is removed and the tip of a syringe (not shown) is inserted into the interior end 24 of the transfer member 14, the entire assembly is inverted and the desired volume of mixed solution drawn into the syringe through the passageway or fluid channel 16, air entering through the filter 46 and air channel 17. This procedure can be repeated to fill the desired number of syringes and the hood 45 can be replaced for storage of the solution until further amounts are required. While use of the transfer unit 10 has been described primarily in conjunction with the transfer of material therein to a second container sealed under a vacuum, the transfer unit 10 can likewise be used in conjunction with a second container which is not sealed under a vacuum. Although a pressure differential between the two containers facilitates the transfer of material from the container 11, the transfer can be effected without it. Under such conditions, the piercing end 19 of the transfer member 14 is thrust through the closure of the second container as previously described. Transfer of the material within the container 11 can then be effected by inverting the containers or otherwise permitting the diluent within the second container to enter the container 11 and thereafter emptying the contents of the container 11 into the second container. Fabricating the container 11 of a flexible plastic will permit manipulation of the container 11 and facilitate transfer in such cases.

FIGS. 9, 10 and 11 illustrate another embodiment 55 of the transfer unit of the present invention comprising a container portion 56, closure portion 57, and transfer member 58. As with the embodiment of FIGS. 1 through 8, the transfer member 58 comprises an elongated body portion 59 having two channels 60, 61 therein, one extending longitudinally the length of the body 59 to provide a passageway 60 for the transfer of material and diluent between the two containers, the second channel providing a passageway 61 for the entry of air into the containers in use, the angularly extending portion 62 of the air channel 61 being covered by a suitable filter 63. On the interior end 64 opposite the piercing end 65 or point on the exterior end 66 of the body 59 is a cutting element 67 comprising a projecting portion 68 extending from the body 59 and depending into the closure 57 when the unit 55 is assembled. The inside of the cutting element 67 is adapted to receive the tip of a syringe. Likewise, an annular flange 69 projects from the body 59 of the transfer member 58 spaced from the interior end 64 thereof and serves to retain the transfer member 58 within the closure portion 57 as hereinafter described.

As can be seen in FIGS. 9 and 11, the closure portion 57 comprises a body 70 having a tubular section 71, the size of the tubular section 71 being such as to provide an interference fit with the opening 72 in the container 56 and is disposed therein to seal the opening 72. The opening 73 within the closure 57 is sealed by a diaphragm 74 which during use of the transfer unit 55, is broken by the cutting element 67 of the transfer member 58 as hereinafter described to permit transfer of the material within the container 56 to the second container. An undercut 75 can be formed in the opening 73 within the closure 57, the undercut 75 receiving a ridge 76 formed in the cutting element 67 of the transfer member 58 to aid in keeping the transfer member 58 and closure 57 in engagement and prevent accidental activation of the unit 55. As best illustrated in FIG. 11, the closure portion 57 includes an enlarged section 77 extending outwardly from the container opening 72, a slot 78 being formed in the enlarged portion 77, the upstanding wall 79 thereof including a shoulder 80. The flange 69 of the transfer member, as seen in FIG. 10, is oblong in shape, and when assembled with the closure 57, is supported by the shoulder 80 thereof. When it is desired to use the transfer unit 55, the transfer member 58 is revolved 90° to align the flange 69 with the slot 78 in the closure 57. The hood (not shown) is removed and the piercing end 65 of the transfer member 58 positioned in place overlying the closure or stopper of the second container. As previously described, the transfer unit 55 is then thrust downwardly to achieve entry through the stopper of the second container and permitting the cutting element 67 to slide within the opening 73 in the closure 57 and puncture the diaphragm 74 thereof. Transfer of the material within the container 56 is then effected as previously described.

In the embodiment 82 illustrated in FIG. 12, comprising a transfer member 83, closure 84 and container 85, the transfer member 83 likewise includes a body 86 having two passageways 96, 97 therein, and a cutting element 87 projecting opposite from the piercing end 88. As illustrated, the transfer member 83 includes a cap portion 89 having threads 90 on the inside thereof for mating with similar threads 91 in the neck 92 of the container 85. The closure 84 comprises a puncturable metal or plastic dam which is sealed over the opening 93 in the container 85 and includes a downwardly extending portion 94 which projects within the opening 93. The closure 84 is crimped over the finish 95 of the container 85 to retain it in place. To use the transfer unit 82, the cap portion 89 is twisted permitting the cutting element 87 to engage the closure 84, puncture it, and thereby permit transfer as previously described. If desired, the cap 89 can be attached to the container 85 by means of a snap fit rather than threaded engagement.

In the embodiments illustrated in FIGS. 1 through 8 and 9 through 11, it is desirable to fabricate the interior and exterior ends of the transfer member of the same size so that the same hood will be interchangable with both ends. Accordingly, prior to use, the hood can be placed on the exterior or piercing end of the transfer member to protect the piercing end and maintain sterility during storage. After the transfer unit is put in use, in those embodiments wherein the transfer member is retained within the stopper of the second container, the same hood can then be placed over the interior end of the transfer member until it is desired to withdraw solution from the second container through the transfer member.

What is claimed is:

1. A transfer unit for transferring a material from a first container to a second container, said transfer unit comprising:

a container having an opening for storing the material to be transferred, a closure sealing the opening in the container and a transfer member constructed and arranged for opening of the closure to permit transfer of the material from the first container to the second container;

said closure including a diaphragm section sealing the opening in the container with means affixing the closure to the container;

and means operatively associated with said closure or said container and said transfer member affording retentive movement of said transfer member toward said sealing diaphragm section of said closure and ready release of said transfer member from said closure;

said transfer member comprising an elongated body portion having two channels therein, one channel extending longitudinally the length of the body to provide a passageway for the transfer of the material between said containers, the other channel extending along said body and terminating outside of said closure to provide a passageway for the entry of air therethrough, the body of the transfer member including a piercing end on the end of the body projecting from the closure and a cutting element extending from the end opposite the piercing end of said body and receivable within the closure to open the closure and permit transfer of material between said containers, said cutting element disposed adjacent the end of said one channel and adapted to receive the tip of a syringe.

2. The transfer unit of claim 1 wherein said means to readily release said transfer member from said closure is defined by a first locking means interconnecting the closure and the container and a second locking means between the closure and the transfer member.

3. The transfer unit of claim 2 wherein the second locking means is constructed and arranged to release the transfer member without releasing the first locking means whereby the container and closure can be removed from the transfer member.

4. A transfer unit for transferring a material from a first container to a second container, said transfer unit comprising:

a container having an opening for storing the material to be transferred, a closure sealing the opening in the container and a transfer member having an end portion disposed in the closure for transfer of the material from the first container to the second container;

said closure comprising a rupturable diaphragm section sealing the opening in the container, a guide extending inwardly into the closure for receiving the end portion of said transfer member with means affixing the closure to the container;

and means operatively associated with said closure or said container and said transfer member affording retentive movement of said transfer member toward said sealing diaphragm section of said closure and ready release of said transfer member from said closure;

said transfer member being disposed within the closure and comprising an elongated body portion having two channels therein, one channel extending longitudinally the length of the body to provide a passageway for the transfer of the material between said containers, the other channel extending along said body and terminating outside of said closure to provide a passageway for the entry of air therethrough, the body of the transfer member including a piercing end on the end of the body projecting from the closure, and a tubular projection extending from the end opposite the piercing end of said body and receivable within the guide in the closure for rupturing said diaphragm, said tubular projection adapted to receive the tip of a syringe adjacent the rupturing end for said diaphragm.

5. The transfer unit of claim 4 wherein said means to readily release said transfer member from said closure is defined by a first locking means interconnecting the closure and the container and a second locking means interconnecting the closure and transfer member.

6. The transfer unit of claim 5 wherein the second locking means is constructed and arranged to release the transfer member without releasing the first locking means whereby the container and closure can be removed from the transfer member.

7. The transfer unit of claim 5 wherein the container has a neck defining an opening with a finish and the closure comprises a body portion having a tubular section, the diameter of the tubular section being coextensive with the diameter of the opening in the container, said tubular section being disposed within said opening, an enlarged portion extending from said tubular section and including a shoulder for abutment with said finish of the neck of the container when the closure is inserted within said opening, said guide disposed within the tubular section and projecting toward the enlarged portion for receiving the tubular projection extending from the body of the transfer member.

8. The transfer unit of claim 7 wherein the first locking means for affixing the closure to the container comprises an undercut formed around the periphery of the tubular section of the closure, and a ridge formed in the opening of the container and projecting inwardly, said undercut and ridge being engageable to retain said closure within the opening in the container.

9. The transfer unit of claim 8 wherein the transfer member includes an annular flange projecting from the body of said member and spaced from the interior end of the body.

10. The transfer unit of claim 8 wherein the second locking means is constructed and arranged to release the transfer member without releasing the first locking means whereby the container and closure can be removed from the transfer member.

11. The transfer unit of claim 10 wherein the container is vacuumized and the transfer member includes an angularly extending portion spaced between the ends of said transfer member, the passageway for the entry of air extending through the angularly extending portion and the body to the piercing end to provide a passageway for the entry of air into the vacuumized container.

12. The transfer unit of claim 11 further including an air filter disposed within the channel in the angularly extending portion of the transfer member to thereby filter any air entering the passageway therein.

13. The transfer unit of claim 12 wherein the tubular projection extending from the body of the transfer member and receivable within the guide in the closure comprises a cutting element for piercing the diaphragm in the guide, the end of the tubular projection having a sharpened end.

14. The transfer unit of claim 13 wherein the guide is defined by a sealing ring extending around the inside of the guide to frictionally engage the tubular projection of the transfer member and prevent the leakage of fluid around said transfer member, aid in maintaining sterility, and keep the transfer member in a rigid position.

15. The transfer unit of claim 4 wherein the closure portion is defined by an enlarged section extending outwardly from the container opening, a slot being formed in the enlarged portion, the upstanding walls thereof including a shoulder, the transfer member including a flange extending therefrom, the flange being receivable within the slot in the enlarged portion, said flange engaging the shoulder in the closure portion prior to use of the transfer unit and being receivable within the slot when the transfer member is revolved to align the flange within the slot whereby the transfer member is movable within the closure portion to thereby permit the tubular projection thereof to engage the diaphragm within the guide in the closure and provide a passageway between the two containers.

16. The transfer unit of claim 1 wherein the transfer member is defined by a cap portion for engagement with the neck of the container, the closure comprising a puncturable dam sealed over the opening in the container and including a downwardly extending portion projecting within the opening in the container, said dam being affixed to the finish of the container to retain it in place.

* * * * *